US007810253B2

(12) United States Patent
Barteet

(10) Patent No.: US 7,810,253 B2
(45) Date of Patent: Oct. 12, 2010

(54) VAMP WITH EDGING

(76) Inventor: Dominique Barteet, 12894 N. Normandy Way, Palm Beach Gardens, FL (US) 33410

( * ) Notice: Subject to any disclaimer, the term of this patent is extended or adjusted under 35 U.S.C. 154(b) by 781 days.

(21) Appl. No.: 11/689,147

(22) Filed: Mar. 21, 2007

(65) Prior Publication Data

US 2007/0209238 A1 Sep. 13, 2007

Related U.S. Application Data

(63) Continuation-in-part of application No. 10/263,179, filed on Oct. 3, 2002.

(51) Int. Cl.
*A43C 13/00* (2006.01)
*A43B 3/24* (2006.01)

(52) U.S. Cl. ..... 36/15; 36/100; 36/101

(58) Field of Classification Search ..... 36/15, 36/100, 101
See application file for complete search history.

(56) References Cited

U.S. PATENT DOCUMENTS

| | | | | | |
|---|---|---|---|---|---|
| 2,607,133 | A * | 8/1952 | Marlowe | 36/11.5 |
| 3,000,116 | A * | 9/1961 | Ally | 36/101 |
| 3,032,896 | A * | 5/1962 | Weaver | 36/101 |
| 3,204,346 | A * | 9/1965 | Lockard et al. | 36/101 |
| 4,103,440 | A * | 8/1978 | Lawrence | 36/101 |
| 4,839,948 | A * | 6/1989 | Boros | 24/662 |
| 4,887,369 | A * | 12/1989 | Bailey et al. | 36/101 |
| 5,992,058 | A * | 11/1999 | Jneid | 36/100 |
| 6,848,199 | B1 * | 2/2005 | Giannelli | 36/11.5 |
| 2002/0194750 | A1 * | 12/2002 | Feick | 36/101 |
| 2007/0261267 | A1 * | 11/2007 | Osborn | 36/15 |
| 2008/0235992 | A1 * | 10/2008 | Stefani | 36/101 |

* cited by examiner

*Primary Examiner*—Marie Patterson
(74) *Attorney, Agent, or Firm*—Feldman Gale, P.A.; Christopher P. Demetriades

(57) ABSTRACT

The invention provides for a vamp bound by an edging that allows the vamp to be attached to a base member of an interchangeable shoe forming assembly without bunching, gathering or pulling out of line.

16 Claims, 2 Drawing Sheets

VAMP WITH EDGING

CROSS REFERENCE TO RELATED APPLICATION

This application is a continuation-in-part of application Ser. No. 10/263,179, filed on Oct. 3, 2002 the contents of which is herein incorporated by reference.

FIELD OF THE INVENTION

The invention generally relates to footwear, particularly to a shoe having interchangeable components and most particularly to a shoe having a conveniently detachable upper referred to herein as a vamp such that said vamp can be releaseably attached to the periphery of a sole member.

BACKGROUND OF THE INVENTION

Although the basic function of footwear is protection of a person's feet, shoes are most often viewed and purchased only with regard to fashion. For example, a person selects a particular pair of shoes to enhance and/or complement clothing worn and when the person changes clothing, since a single color and/or style of shoes will not match all colors and/or styles of clothing he/she, more often than not, must select another pair of shoes, Thus, in order to be fashionably dressed, a person must own many pairs of shoes.

Unfortunately, owning multiple pairs of shoes can be very expensive in terms of both cost and storage space. Footwear that is compatible with many styles of clothing would alleviate these disadvantages by reducing the number of pairs of shoes a person must own, thereby also freeing up storage space. An example of such footwear is shoes having interchangeable components including interchangeable upper referred to as vamps.

While other shoes systems have existed incorporating detachable vamps, none of the prior art provide an interchangeable vamp that is well suited when the vamp is made of relatively soft or flexible materials including, by way of example only, neoprene, rubber or other polymer materials. While such materials are particularly useful in that they are comfortable, relatively inexpensive to manufacture, capable of easy decoration by various techniques including but not limited to silkscreening and thereby capable of taking on a wide variety of styles and appearances, and, further, are interchangeable across a variety of differently sized base members, they suffer from the drawback that when affixed by means of mechanical snaps, hook-and-loop systems or otherwise similar fasteners, the lower edge of the vamp tends to gather, bunch or pull out of alignment with the edge of the base member. In other words, the edge of the vamp does not remain in a line with the peripheral edge of the base member and therefore the aesthetic appearance of the shoe is compromised.

Previous attempts to resolve this issue have failed as the need to utilize an edging having appropriate characteristics has heretofore been unknown in the art. Thus where satin finished webbing material such as the Black Polypropelene Material, Part #N00881 1", manufactured by the Steed Co. has been employed, the edging fails to ameliorate or prevent the tendency of the vamp to gather, bunch or pull out of alignment.

The edging must therefore be of a certain stiffness and rigidity capable of adequately securing the vamp to the base while preventing the unsightly tendency of the vamp to be pulled out of alignment. The edging, furthermore, when the same or similar color as the base member, may also serve the further aesthetic purpose of producing the appearance of a seamless transition between vamp and base member. Alternatively the edging may be of a color to accent or otherwise improve the aesthetic appearance of the shoe. Accordingly, it would be desirable to provide a shoe having an interchangeable vamp which is readily affixed in a secure manner to the base member without compromising the aesthetic appeal of the shoe.

SUMMARY OF THE INVENTION

Accordingly, it is an object of the present invention to provide for a vamp for use in conjunction with an interchangeable shoe assembly that remains readily affixed to the base of the shoe while avoiding the unsightly tendency of the vamp to bunch or gather or otherwise to pull out of alignment where the vamp attaches to the base member.

Further objectives of the invention claimed herein are to provide added strength to the vamp which may have a tendency to wear out as the vamps are interchanged by the wearer. Additionally, the edging may carry out the aesthetic function of serving to mask the transition between vamp and shoe base or alternatively to provide a decorative accent.

Other objectives and advantages of the instant invention will become apparent from the following description taken in conjunction with the accompanying drawings wherein are set forth, by way of illustration and example, certain embodiments of the instant invention. The drawings constitute a part of this specification and include exemplary embodiments of the present invention and illustrate various objects and features thereof.

Figure 1:
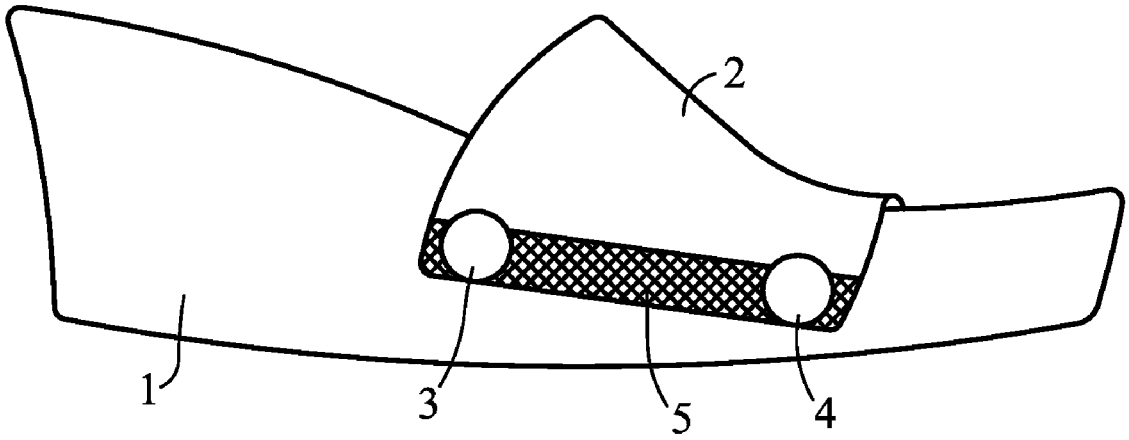
FIG. 1 is a side view of an interchangeable shoe assembly with a vamp bound by edging affixed to the base member of the shoe by means of fasteners, here mechanical snaps.

The preferred embodiments of the instant invention will hereinafter be described in conjunction with the appended drawings provided to illustrate and not to limit the invention, and in which:

DETAILED DESCRIPTION OF THE INVENTION

For the purposes of promoting an understanding of the principles of the invention, reference will now be made to the embodiments illustrated in the drawings and specific language will be used to describe the same. However, the illustrated embodiments are merely exemplary. It is understood that no limitation of the scope of the invention is thereby intended. Any alterations and further modifications in the illustrated devices, and such further application of the principles of the invention as illustrated herein are contemplated as would normally occur to one skilled in the art to which the invention relates.

Shown throughout the figures, the instant invention is generally directed to footwear, particularly shoes and sandals having a simple, convenient fastening system capable of releasably attaching a vamp to a shoe sole, wherein the vamp is bound by an edging that allows a couplable detachment while preventing or ameliorating the unsightly tendency of the shoe to bunch or gather or otherwise pull out of alignment with the base member.

An embodiment of the vamp, as part of an shoe-forming assembly, is illustrated in FIG. 1. This footwear is preferably in the form of a shoe or sandal and generally includes a sole or shoe base member, 1, a vamp or upper member, 2, and fastening members, for example, snap fasteners 3, and 4. The vamp member may be fabricated of polymer compositions or other synthetic or non-synthetic rubber materials such as neoprene. Various other, natural materials may also be used to fabricate vamps including leather, canvas or other cloths. In any situation where the vamp is made of relatively soft or flexible materials, peripheral edges of the vamp may be bound to address the concerns discussed above and herein.

As shown in FIG. 1, the fasteners, here mechanical snaps 3 and 4, are disposed laterally along the edge of the base member, 1. Where no edging is used, or insufficiently strong or stiff material is used to edge the vamp, 2, the vamp tends to gather and bunch at the fasteners, 3 and 4. This compromises the aesthetic, and therefore commercial, appeal of the shoe. The vamp also has a tendency to pull out of alignment with the base member, 1, and the fasteners, 3 and 4. When bound by edging, 5, with appropriate characteristics, however, the problems identified above are either prevented or ameliorated.

Figure 2:
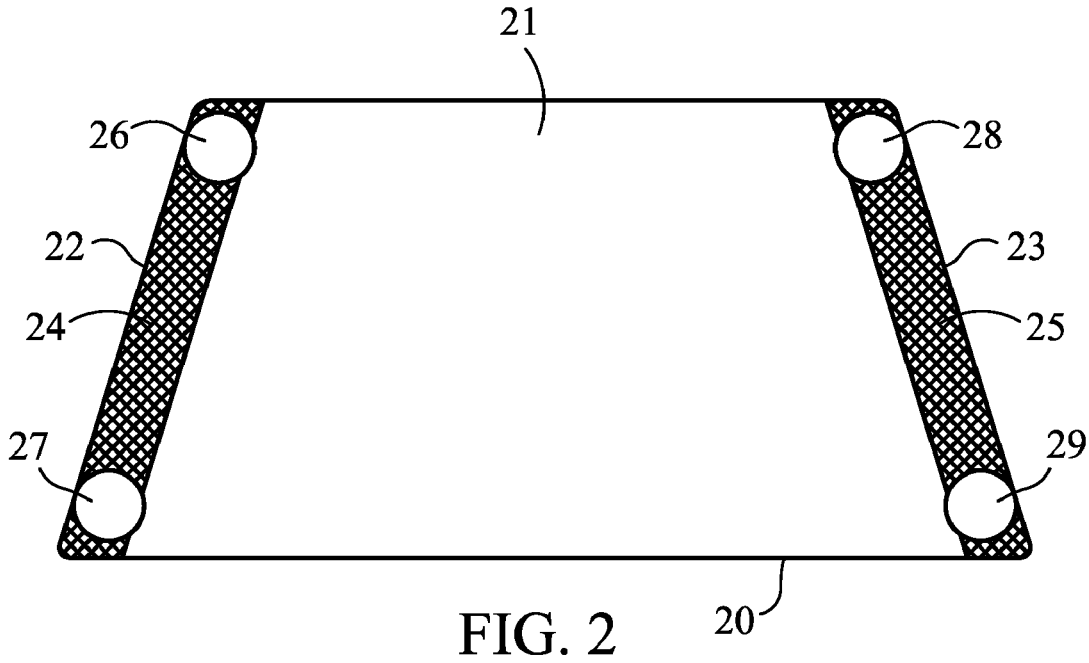
FIG. 2 is a top view of a vamp bound by edging according to the present invention.

FIG. 2 shows a top view of the upper portion, 21, of a trapezoidal-shaped vamp 20. The peripheral sides, left 22 and right 23, of the vamp, 1, are bound by edging 24 and 25. The edging, 24 and 25, consists of an elongated, rectangular strip of material having appropriate characteristics of strength and stiffness, and folded through the center, at the respective edges, 22 and 23, of the vamp and is bound to and covers the right, 22 and left, 23, peripheral sides of vamp member, 20. The edging generally covers (but is not limited to) about a half inch of the upper and lower surfaces of the vamp, i.e. edging 24 and 25 cover the upper surface of the, respectively left and right peripheral edge. The edging may be attached to the vamp by any suitable method, including, but not limited to gluing or stitching.

Figure 3:
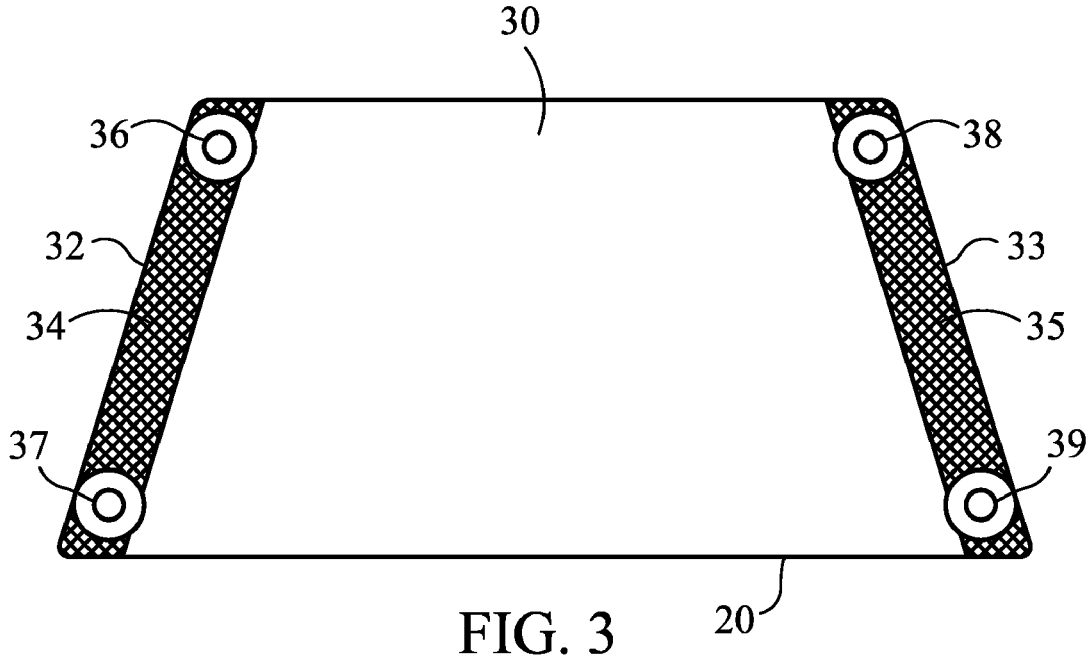
FIG. 3 is a bottom view of a vamp bound by edging according to the present invention.

FIG. 3 shows a bottom view of the lower portion, 30, of a trapezoidal-shaped vamp 20 having edging, 34 and 35, that covers lower surface 33 of the vamp at the peripheral edges, 32 and 33. The edging, 5, 24, 25, 34 and 35, (FIGS. 1, 2 and 3), is of a strength and stiffness such that the edging holds the left and right peripheral edges, 21, 22, 32 and 33 of the vamp in line with the fasteners at 26, 27, 28 and 29, and further prevents the vamp from bunching and gathering at those points. The addition of edging, 5, 24, 25, 34 and 35, further strengthens the fasteners such that the vamp portion can withstand repeated release and exchange without breaking and/or wearing out. The edging, 5, 24, 25, 34 and 35 is preferably constructed from, but is not limited to, a nylon material. An example of such a material is the Nylon Heatset N0023S-1 manufactured by Tape Craft, Inc. That particular nylon webbing is a blend of three types of nylon yarn, i.e. 840 denier type 6 gauge thread, 420 denier type 6 gauge and 210 type 66 gauge yarn. The material is solution dyed and a medium heat set is applied to provide a medium "starch" to the material. Further the binders and stuffing used in the webbing are all nylon materials. The webbing is 1" in width and 0.034" in thickness and further possesses a tensile strength of 1350 LBF. Materials possessing characteristics similar in respect to strength and stiffness as the Nylon Heatset N0023S-1 are flexible enough for use to edge vamps in the instant system yet strong and stiff enough to prevent the tendency of the material to gather, bunch or pull out of alignment with the peripheral edge of the base member. Whatever material is used, the material must be of a strength and stiffness to avoid the problems identified above, i.e bunching, gathering and pulling out of line (in the area wherein the fasteners are attached).

All patents and publications mentioned or incorporated into this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes nay be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantage mentioned, as well, as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A vamp for use in an interchangeable shoe assembly having a base member and an interchangeable vamp, said interchangeable vamp comprising a flexible planar surface having left and right peripheral edges, a top face, and a bottom face, first and second attachment means, and a first and second strip of edging material, said first strip of edging material being affixed to said interchangeable vamp along said left peripheral edge and to said top face and said bottom face of said planar surface in proximity to said left peripheral edge;

said first strip of edging material having first attachment means capable of joining said first strip of edging material with or releasing said first strip of edging material from said left side of said base member, said second strip of edging material being affixed to said interchangeable vamp along said right peripheral edge and to said top face and said bottom face of said planar surface in proximity to said right peripheral edge;

said second strip of edging material having first attachment means capable of joining said second strip of edging material with or releasing said second strip of edging material from said right side of said base member, said edging material and said attachment means capable of maintaining said left and right edges of said interchangeable vamp in a substantially rigid position relative to the plane of said base member when said vamp is attached to said base member while the shoe assembly is being worn.

2. A vamp according to claim 1, wherein the interchangeable vamp is fabricated from a relatively soft or flexible material.

3. A vamp according to claim 2, wherein the soft or flexible vamp material is derived from a polymer composition or a synthetic or non-synthetic rubber material.

4. A vamp according to claim 2, wherein the interchangeable vamp is fabricated from leather, or canvas or other cloth material.

5. A vamp according to claim 1, wherein the strip of edging comprises a nylon heat set material.

6. A vamp according to claim 5, wherein the nylon heat set material is provided in the form of webbing capable of heat set.

7. A vamp according to claim 6, wherein the webbing comprises 840 dernier type 6 gauge thread, 420 dernier type 6 gauge thread, or 210 dernier type 6 gauge thread, or combination thereof.

8. A vamp according to claim 6, wherein the webbing possesses a tensile strength of about 1350 LBF.

9. A shoe assembly comprising:

a base member, an interchangeable vamp, left and right attachment means, and left and right stiffening strips, said base member having a left and a right side extending longitudinally along at least a portion of said base member, said interchangeable vamp comprising a flexible planar surface having left and right peripheral edges, a top face, and a bottom face, said left and right attachment means each comprising inner and outer releasable interlocking components, said left side of said base member and said right side of said base member each having one or more inner releasable interlocking components affixed thereto, said left stiffening strip being attached to said interchangeable vamp along said left peripheral edge and to said top face and said bottom face of said planar surface in proximity to said left peripheral edge; said left stiffening strip having one or more outer releasable interlocking components affixed thereto, each outer releasable interlocking component affixed to said left stiffening strip capable of joining with or releasing from one of said inner releasable interlocking components affixed to said left side of said base member, said right stiffening strip being attached to said interchangeable vamp along said right peripheral edge and to said top face and said bottom face of said planar surface in proximity to said right peripheral edge; said right stiffening strip having one or more outer releasable interlocking components affixed thereto, each outer releasable interlocking component affixed to said right stiffening strip capable of joining with or releasing from one of said inner releasable interlocking components affixed to said right side of said base member, said left and right stiffening strips holding said left and right peripheral edges of said interchangeable vamp in a substantially rigid position in relation to said base member when said inner and outer releasable interlocking components are joined together, and said stiffening strips and said peripheral edges of said interchangeable vamp being flexibly detachable from said base member when said releasable inner and outer interlocking components are released from each other.

10. A vamp according to claim 9, wherein the interchangeable vamp is fabricated from a relatively soft or flexible material.

11. A vamp according to claim 10, wherein the soft or flexible vamp material is derived from a polymer composition or a synthetic or non-synthetic rubber material.

12. A vamp according to claim 10, wherein the interchangeable vamp is fabricated from leather, or canvas or other cloth material.

13. A vamp according to claim 9, wherein the strip of edging comprises a nylon heat set material.

14. A vamp according to claim 13, wherein the nylon heat set material is provided in the form of webbing capable of heat set.

15. A vamp according to claim 14, wherein the webbing comprises 840 dernier type 6 gauge thread, 420 dernier type 6 gauge thread, or 210 dernier type 6 gauge thread, or combination thereof.

16. A vamp according to claim 6, wherein the webbing possesses a tensile strength of about 1350 LBF.

* * * * *